US007967188B2

(12) United States Patent
Hickox

(10) Patent No.: US 7,967,188 B2
(45) Date of Patent: Jun. 28, 2011

(54) UMPIRE COUNTER WITH NULL INDICATORS

(76) Inventor: Edwin W. Hickox, Port Orange, FL (US)

( * ) Notice: Subject to any disclaimer, the term of this patent is extended or adjusted under 35 U.S.C. 154(b) by 388 days.

(21) Appl. No.: 12/359,678

(22) Filed: Jan. 26, 2009

(65) Prior Publication Data

US 2010/0187297 A1 Jul. 29, 2010

(51) Int. Cl.
*A63B 53/14* (2006.01)

(52) U.S. Cl. ..... 235/1 B; 235/78 G; 235/103

(58) Field of Classification Search ..... 235/60.34, 235/60.28, 78 G, 103, 123, 1 B
See application file for complete search history.

(56) References Cited

U.S. PATENT DOCUMENTS

| | | | | |
|---|---|---|---|---|
| 2,980,055 | A | | 4/1961 | Burns |
| 2,993,288 | A | | 7/1961 | Rothman |
| 3,455,273 | A | | 7/1969 | Willingham, Jr. |
| 3,501,744 | A | * | 3/1970 | Simjian ..... 705/403 |
| 3,554,159 | A | | 1/1971 | Klupt |
| 3,755,939 | A | | 9/1973 | Denega et al. |
| 4,072,125 | A | | 2/1978 | Spalla |
| D314,711 | S | | 2/1991 | Cox |
| D323,629 | S | | 2/1992 | Murphy |
| D341,094 | S | | 11/1993 | Austin |
| D349,859 | S | | 8/1994 | Asano |
| 5,877,480 | A | | 3/1999 | Tuso et al. |
| D519,391 | S | | 4/2006 | Leung |
| D525,884 | S | | 8/2006 | Copia |
| D545,698 | S | | 7/2007 | Yount |
| D546,209 | S | | 7/2007 | Kelley |
| 2007/0030128 | A1 | | 2/2007 | Hills et al. |

* cited by examiner

*Primary Examiner* — Karl D Frech
(74) *Attorney, Agent, or Firm* — John S. Child, Jr.; John J. Simkanich

(57) ABSTRACT

A handheld, thumb or finger operated, umpire's counter having three dials to indicate the count kept by the umpire for each of "strikes", "balls", and "outs". Each dial has associated with it a null indicator having a tactile output perceptible to the touch. This tactile output enables the umpire to determine when the respective dial is set to "0", or to set and/or reset a respective dial to "0" without looking at the counter. It also permits the umpire to confirm that each dial is indeed set to "0" before he begins counting.

12 Claims, 7 Drawing Sheets

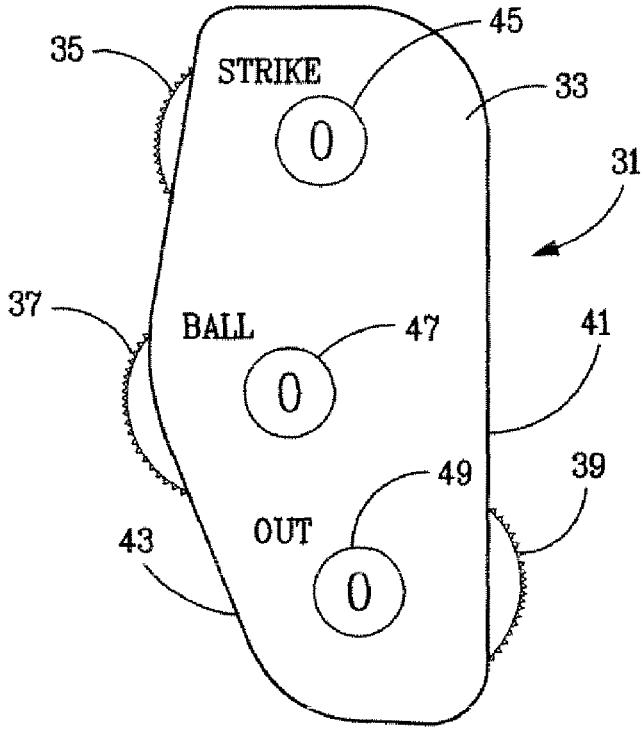
Prior Art
FIG. 1
FIG. 2A
Prior Art
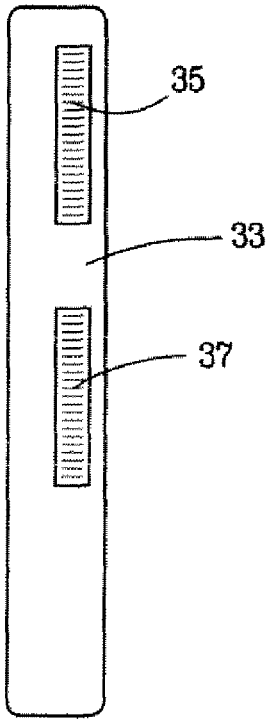
FIG. 2B
Prior Art
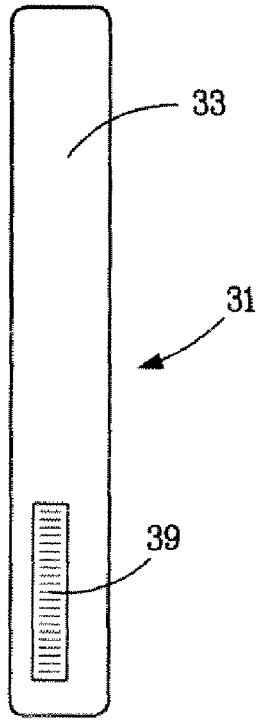

UMPIRE COUNTER WITH NULL INDICATORS

BACKGROUND OF THE INVENTION

The present invention relates to sports umpire counters, also called umpire indicators. Home plate umpires, during a game of baseball, or softball, are responsible for keeping track of the number of "strikes" and "balls" on a batter and the number of "outs" in an inning. Umpires and referees in other sports are also required to keep count of various events.

Handheld counters have been used for this purpose. Generally, these counters have included a plurality of rotary dials which carry indicia on one face. This indicia is most commonly Arabic numerals, i.e., numbers, indicating the number of "strikes" from 0 to 3, the number of "balls" from 0 to 4, and the number of "outs" from 0 to 3.

The numbers are spaced about the face of each dial to appear, individually, to be read in a viewing window when the dial is turned to indicate that number. The dials generally are indexed with detents to hold the dial at each number when the number is centered in the dial's viewing window. The detent action gives a physical stop to the rotary movement of each dial and an auditory "click" sound. This provides a positive indication that a new number has been dialed into the window. Detents can also perform ratchet functions which permit a dial to be turned in only one direction of rotation.

A popular umpire counter used by many umpires, including many umpires in Major League Baseball®, is model "Diamond PI3 Umpire Indicator" sold by the Rawlings Corporation, FIGS. 1, 2*a* and 2*b*. This counter has a flat elongate body with rounded edges and a long straight side and an opposite angled side. This shape fits the palm of the umpire's hand.

An umpire can call "time out" to visually inspect his counter to confirm the status of the count for balls and strikes on the current batter, and to confirm the number of outs in an inning. However, this can disrupt the rhythm of the game. Moreover, when glancing at a hand-held counter, the umpire must take his eyes off the field of play.

It is advantageous that an umpire be able to operate his counter with as little distraction as possible from his duties, including but not limited to his view of the field of play, his view of the ball, his view of the players and coaches, and his view of the other umpires.

It is also advantageous that an umpire be able to reset his counter dials to "0", or any other number, without having to look at the counter.

It is therefore desirable that an umpire's counter indicate one or more positions for each dial to provide a tactile indication of dial position which is perceptible to the touch and could be readily sensed by the umpire. This would reduce the need to look at a counter when resetting the dials to read "0" or another selected number.

It is therefore desirable to have a tactile output on the counter which would indicate when a counter dial is set to "0" or another number.

SUMMARY OF THE INVENTION

An objective of the present invention is to provide a manual, dial operated, handheld, umpire's, or other sports official's counter, for recording "strikes", "balls", and "outs", or other events of interest. An individual tactile null indicator (or other number indicator) is associated with each dial and/or numbers.

This objective is reached in a thumb or finger dial, operated, handheld, baseball or softball or other sport, umpire's counter where each respective dial is a round disk and has a tactile feature associated therewith. This tactile feature is positioned to indicate, and operates to indicate, when that respective dial is set to read "0" or another number of interest. It is positioned at a predetermined location with respect to each dial and functions to indicate and/or confirm that the respective dial is set in the zero/null position, when the respective dial's window shows a count of "0", or other number.

Each of the dials on the counter is ratcheted to turn in one direction only, that being of increasing count. The ratcheting structure also performs an indexing of a dial's rotation.

The tactile feature can be located on each dial or adjacent thereto. However the tactile feature's close proximity to the dial to which it is to provide the indication of dial position is imperative.

The counter includes an elongate case with rounded corners and a long straight side and a long angled opposite side. Three round disk-shaped dials are mounted for rotation within the case, being one for strikes, one for balls and one for outs. Each dial carries numbers from 0 to 3 or 0 to 4, as appropriate, being spaced about one of its two faces. These numbers are viewed through a respective round viewing window in one face of the case.

Each of the dials extends partially through one of the two long opposite side walls of the counter case. The exposed outward extension of each dial is such that an arc portion of the dial's circumference is exposed, i.e., protrudes beyond the side wall of the case. The circumferential edge of each dial is serrated for finger friction in turning the dial.

In one instance, the tactile feature is implemented with a smooth-walled notch in the circumference of a dial. This notch is approximately rectangularly-shaped with an arc width of about 15 to 20 circular degrees. The notch is positioned diametrically opposite the number "0" on the dial so that the notch can be felt with a thumb or finger when dial's zero/null position is indexed to the viewing window related to that dial, i.e., so that the "0", or other number, is showing.

In another instance, the tactile feature is implemented with a smooth-surfaced bump-out or button structure on the circumference of a dial, or a smooth-surfaced, flat, cordial surface on the circumference of a dial diametrically opposite the number "0", so that these tactile features are outboard of the respective case/housing side wall when the dial reads "0", or another number.

In yet another instance, the tactile feature is implemented with a spring biased pin or rod which protrudes adjacent its respective dial and is retracted when the dial reads "0", or another number.

BRIEF DESCRIPTION OF THE DRAWINGS

The features, advantages and operation of the present invention will become readily apparent and further understood from a reading of the following detailed description with the accompanying drawings, in which like numerals refer to like elements, and in which:

FIG. 1 is a face view of a Rawlings Corporation model "Diamond PI3" umpire's counter;

FIG. 2*a* is the angled side wall view of the counter of FIG. 1;

FIG. 2*b* is the straight side wall view of the counter of FIG. 1;

DETAILED DESCRIPTION OF THE INVENTION

Figure 3:
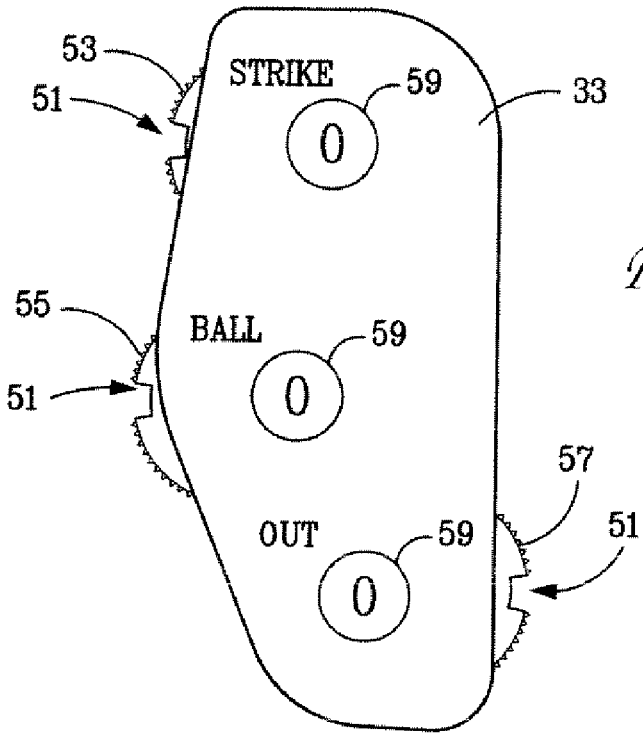
FIG. 3 is a face view of the umpire's counter of the present invention.

The present invention is a manually operated counter for keeping track (creating a visual output) of sequential events, comprising, at least one dial which is rotatably adjustable for sequentially displaying a sequence of each of a plurality of indicia. Each dial is sequentially rotated and is permitted to move in only one direction of rotation. Continued rotation can reset each dial to its initial position, to permit a repeat of the sequence. A tactile indicator associated with each dial indicates when the dial is in the initial position.

Such manually operated counters are usually used by baseball and softball umpires, or another sports official or event keeper, and sometimes by umpires and referees in other sports, in keeping track of a number of events, such as "strikes" and "balls" on a batter, and in keeping track of the number of "outs" in an inning.

A popular model for an umpire's counter 31 is the Rawlings Corporation model "Diamond PI3", FIGS. 1, 2*a* and 2*b*. This counter 31 has a thin, elongate case/housing 33 with three dials 35, 37, 39 mounted within the case 33 for dialing the number of "strikes", "balls" and "outs", respectively. The third dial 39 is positioned near the bottom of the long straight side 41 of the case 33. While the first and second dials 35, 37 are respectively positioned near the top and the middle of an opposite angled side 43.

Each of the dials 35, 37, 39 is round disk-shaped with numbers printed on or embossed on one face, these numbers being spaced about the disk in a circular arrangement. Three round viewing windows or ports 45, 47, 49 open through the front face of the case 33 for viewing the "strikes" count, the "balls" count, and the "outs" count, respectively. These windows 45, 47, 49 are positioned and sized so that only one number, printed on the respective dial 35, 37, 39, appears at a time.

The dials 35, 37, 39, each have a serrated circumferential edge for grip, FIGS. 2*a*, 2*b*.

The present invention adds a tactile, dial position indicator to the previous structure of the model "Diamond PI3" umpire's counter. This indicator structure enables an umpire to determine when each dial is in the null/zero position to begin a new count of "strikes", "balls", and "outs".

Figure 3A:
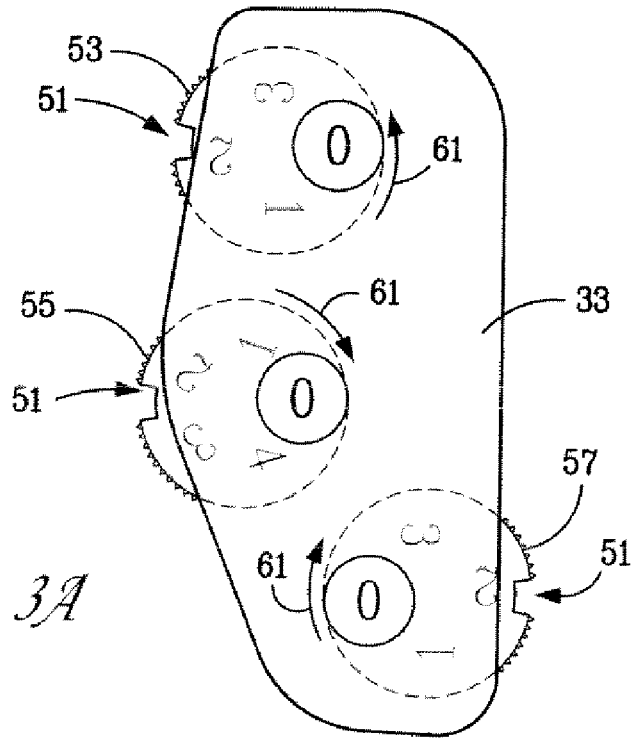
FIG. 3*a* is a face view of the present invention of FIG. 3 showing the three dials in phantom.
Figure 4A:
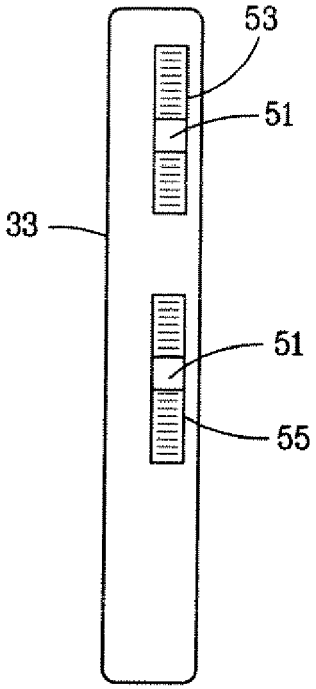
FIG. 4*a* is the angled side wall view of the present invention of FIG. 3.
Figure 4B:
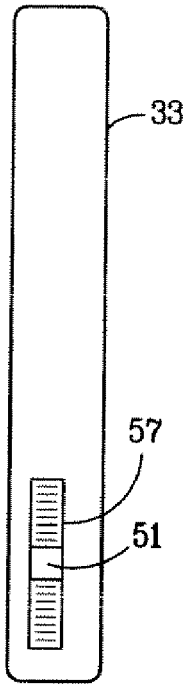
FIG. 4*b* is the straight side wall view of the present invention of FIG. 3.
Figure 7:
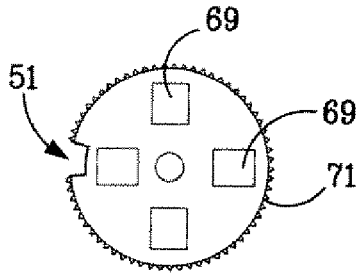
FIG. 7 is a bottom face view of a four numbered dial.
Figure 8:
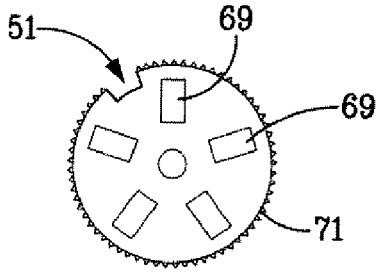
FIG. 8 is a bottom face view of a five numbered dial.

A first embodiment of the invention, FIGS. 3-8*a*, has a single, smooth-walled, large notch 51 having an absence of serrations and extending into the circumferential edge of each round disk-shaped counter dial 53, 55 and 57, FIGS. 3 and 3*a*. Each of the notched dials 53, 55, 57 is about one inch in diameter and carries an otherwise serrated circumferential edge. For a dial 53, 55, 57 which is about one inch in diameter, each notch is about 1/16 inch deep and about 1/8 to 3/16 inches wide at its "mouth", wherein each notch 51 has an arc width of about 15 to 20 circular degrees. Each of the notched dials 53 and 57 carries numbers on its front face from "0" to "3", FIGS. 3*a* and 7*a*. The notched dial 55 carries numbers on its front face from "0" to "4".

Figure 7A:
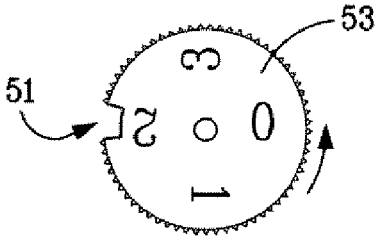
FIG. 7*a* is a top face view of the "strikes" dial of the present invention of FIG. 3.
Figure 7B:
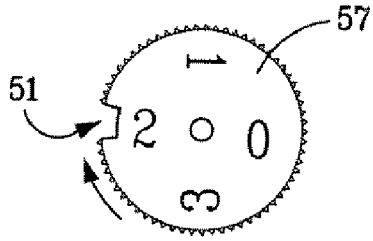
FIG. 7*b* is a top face view of the "outs" dial of the present invention of FIG. 3.
Figure 8A:
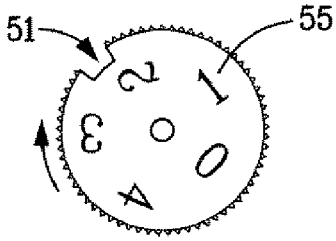
FIG. 8*a* is a top face view of the "balls" dial of the present invention of FIG. 3.

Each of the dials 53, 55, and 57 has its numbers spaced evenly around the periphery of its top face, FIGS. 7*a*, 7*b* and 8*a* in "merry-go-round" fashion. The numbers on each dial 53, 55, 57 are viewable through the top face of the counter case through a respective round viewing opening or window 59, positioned above each respective dial, FIGS. 3 and 6. Each of the dials 53, 55, and 57 are shown in phantom in FIG. 3*a*, as each reading "0". The arrows 61 show the direction or rotation each dial is permitted to turn.

Each notch 51 is formed with square corners at the dial circumferential edge. Each notch is wide enough for a "pinch" of skin of the pad at the distal end of a thumb or finger to "feel" the presence of the notch 51 when it is facing outwardly from the case 33, FIGS. 3, 4*a* and 4*b*.

Figure 5:
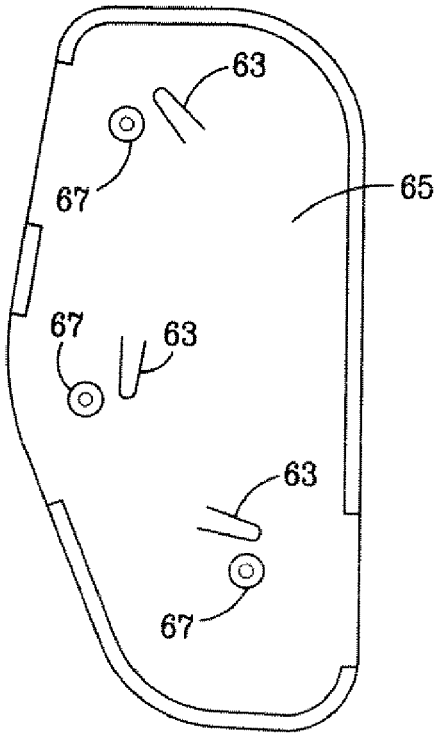
FIG. 5 is a view of the inside wall of the back of the counter case showing the detent index arms for each dial.
Figure 6:
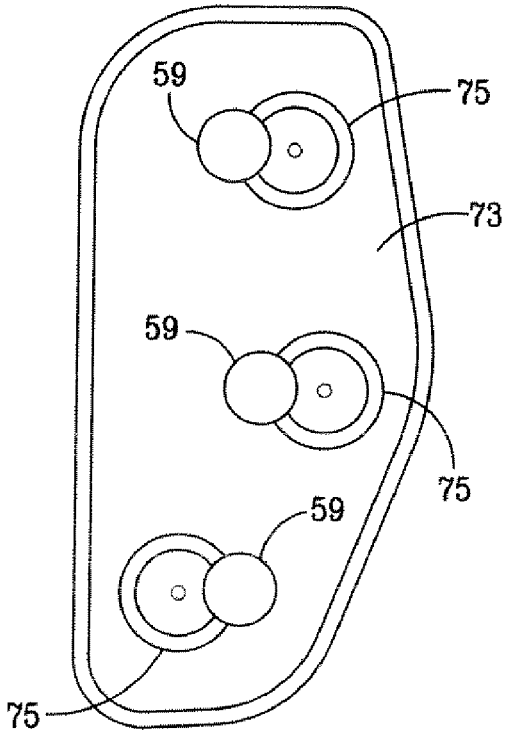
FIG. 6 is a view of the inside wall of the face of the counter case showing the viewing windows.

A respective spring arm detent 63 is each positioned on the inside bottom wall 65 of the case 33 near a respective spindle 67 on which a respective dial 53, 55, 57 rotates, FIG. 5. The bottom faces of a four-numbered dial, FIG. 7, and a five-numbered dial, FIG. 8, each carry a plurality of identical cavities 69. The circumferential edge of each dial carries a series of serrations 71 providing a sure gripping/friction surface for turning/rotating each dial 53, 55, 57.

The end of each spring arm detent 63 snaps into a respective one of the rectangular cavities 69 when a number of the dial is positioned under a viewing window. This spring snap creates an audible sound. The outward angle of the arm 63 positions its end against the inside wall of a cavity 69 to inhibit the reverse rotation of each dial. The correct rotation of a dial causes the arm 63 to bend as it is retraced from the respective cavity 69 by that cavity being rotated forward.

The inside top wall 73 carries the three round viewing windows 59. An offset raised circular abutment 75 minimizes any wobble in the rotation of each dial 53, 55, 57.

Figure 9A:
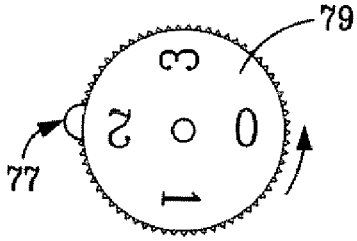
FIG. 9*a* is a top face view of the "strikes" dial of the present invention with a bump-out or button-type, alternate, tactile position indicator.
Figure 9B:
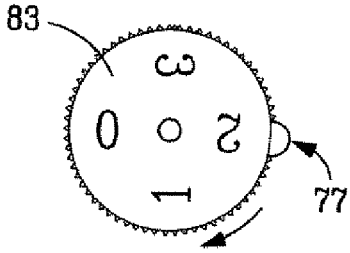
FIG. 9*b* is a top face view of the "outs" dial of the present invention with a bump-out or button-type, alternate, tactile position indicator.
Figure 9C:
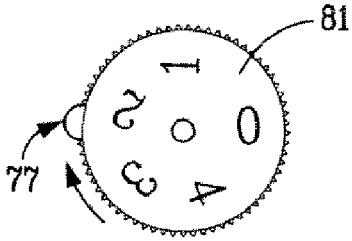
FIG. 9*c* is a top face view of the "balls" dial of the present invention with a bump-out/button-type, alternate, tactile position indicator.

The tactile indication of dial's null position, i.e., a "0" appearing in a viewing window 59 of the invention, can be implemented in alternative ways. The notch 51, on each of the dials, FIGS. 7*a*, 7*b*, 8*a*, can be replaced by a protruding bump-out or button 77, on each of the "strikes", "balls", "outs" respective dials 79, 81, 83, FIGS. 9*a*, 9*b*, 9*c*. Such a bump-out or button 77, when positioned on the portion of a dial 79, 81, 83 extending outwardly on the outside of the case 33 is a structure which an umpire can "feel" as being different from the remainder of the circular, disk-shaped, serrated dial 79, 81, 83.

Figure 10:
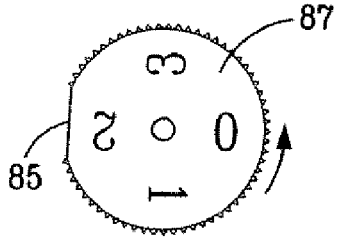
FIG. 10 is a top face view of the "strikes" dial of the present invention with a flat, cordial-type, alternate, tactile position indicator.
Figure 11A:
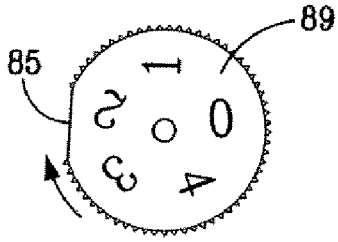
FIG. 11*a* is a top face view of the "balls" dial of the present invention with a flat, cordial-type, alternate, tactile position indicator.
Figure 11B:
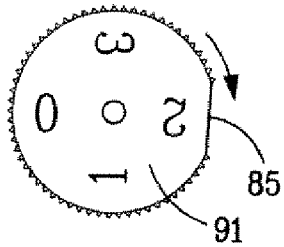
FIG. 11*b* is a top face view of the "outs" dial of the present invention with a fiat, cordial-type, alternate, tactile position indicator.

The notch 51, on each of the dials, FIGS. 7*a*, 7*b*, 8*a*, can also be replaced by a flat surface (cordial surface) 85, FIGS. 10, 11*a* and 11*b*, on the "strikes" dial 87, the "balls" dial 89, and the "outs" dial 91, respectively. When a number "0" is in the viewing window 59, the flat portion of each dial is outside of the case 33.

Figure 12:
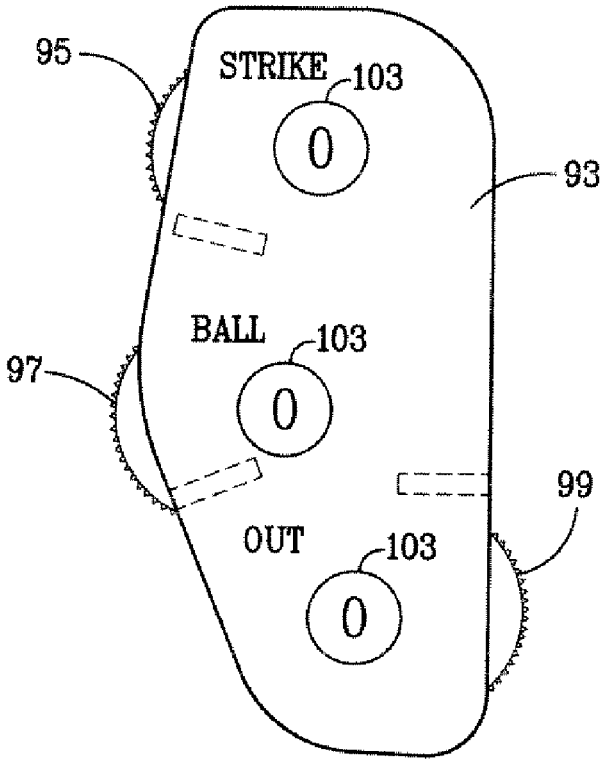
FIG. 12 is a face view of the counter of the present invention with further, alternate, position indicators shown in phantom in the retracted position.
Figure 13:
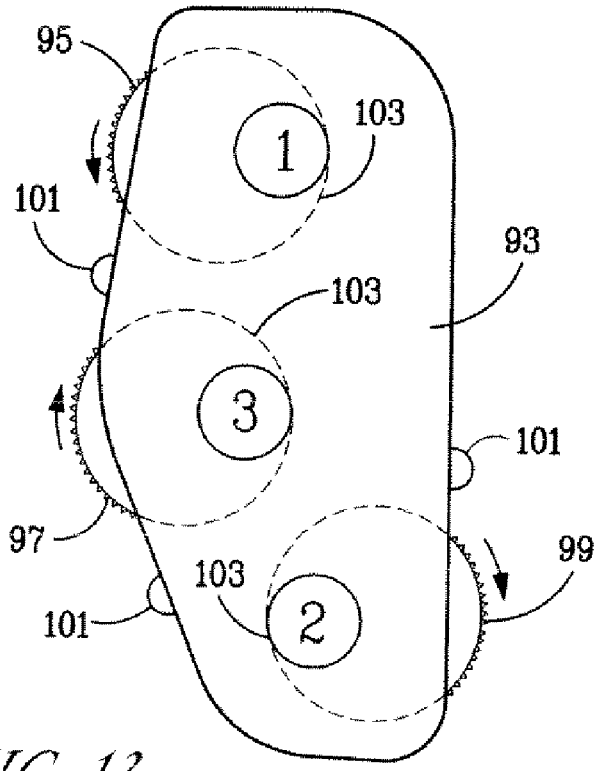
FIG. 13 is a face view of the counter of FIG. 12 with the position indicators protruding from the counter case.

The tactile indicator can also be located in a position other than on a dial. This would require modifying the housing/case. Modified housing/case 93 permits a spring biased rod or pin to extend outward adjacent to a respective serrated dial 95, 97, 99, FIGS. 12 and 13. These three pins/rods 101, FIG. 13 extend outwardly beyond the sidewalls of the case 93 when a number other than "0" appears in a viewing window 103. They are withdrawn into the case 93 when the count for a dial is the number "0". Alternately, the orientation of the structure can be modified to have the pins/rods 101 withdrawn into the case 93 when the dial reads another selected number.

Figure 14:
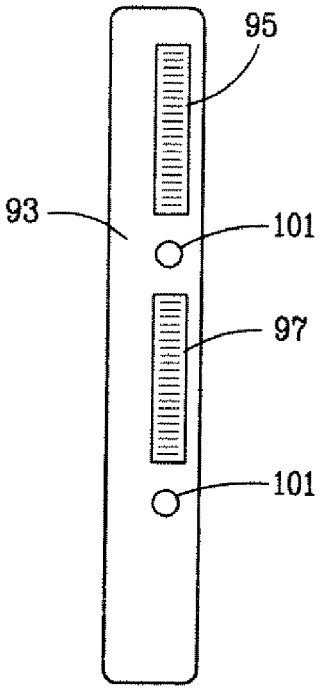
FIG. 14 is an angled side view of the counter of FIG. 12.
Figure 15:
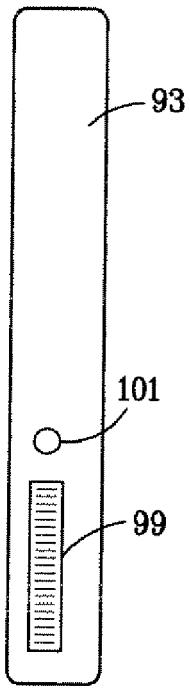
FIG. 15 is a straight side view of the counter of FIG. 12.

Each indicator rod 101 is located immediately adjacent its respective dial 95, 97, 99, FIGS. 14, 15. The rods 101 are round and have a smooth rubber outer tip 105, FIGS. 20, 21. This again provides a tactile indicator to an umpire of the null positioning of each of the dials 95, 97, 99.

Figure 18:
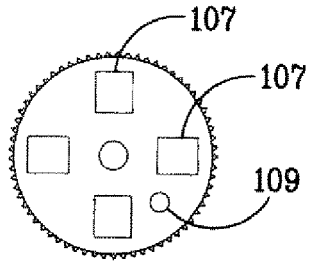
FIG. 18 is a bottom face view of a four numbered dial for the counter of FIG. 12.
Figure 19:
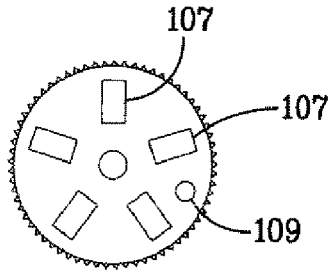
FIG. 19 is a bottom face view of a five numbered dial for the counter of FIG. 12.

The bottom face of each four-numbered dial 95, 99, FIG. 18, i.e., "0"-"3", and the bottom face of the five numbered dial, FIG. 19, i.e., "0"-"4", contain the same number and positioning of rectangular cavities 107 as the two previous embodiments of the invention. In addition, each dial 95, 97, 99 carries a camming button 109 on the bottom face, adjacent the cavity 107 of the highest number on the dial, FIGS. 18*a*, 18*b*, 18*c*, 19*a*, 19*b*.

Figure 16:
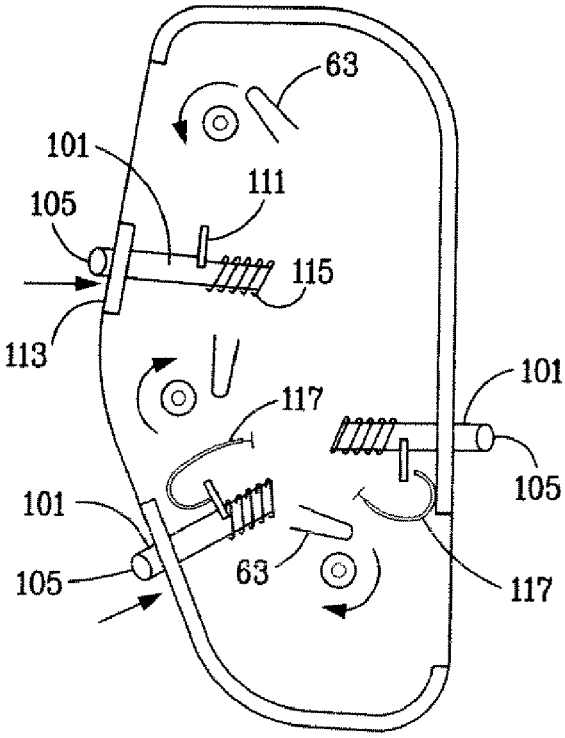
FIG. 16 is a view of the inside wall of the back of the counter case showing the detent index arms, the position indicators and their activators for the counter of FIG. 12.
Figure 17:
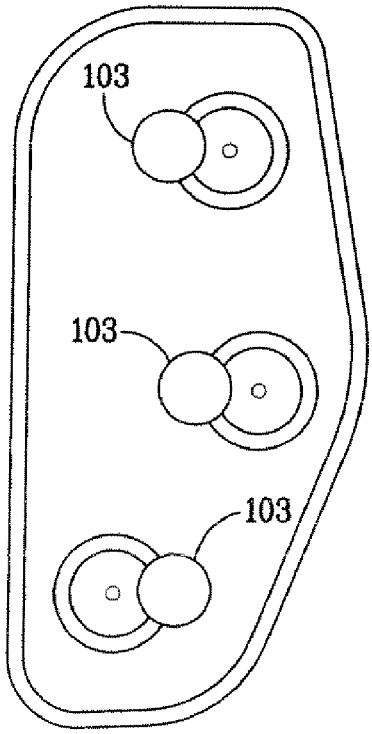
FIG. 17 is a view of the inside wall of the face of the counter case showing the viewing windows for the counter of FIG. 12.
Figure 18A:
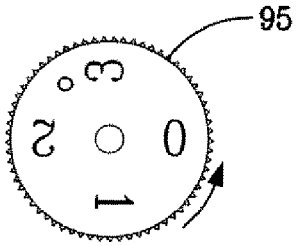
FIG. 18*a* is a top face view of the "strikes" dial for the counter of FIG. 12.
Figure 18B:
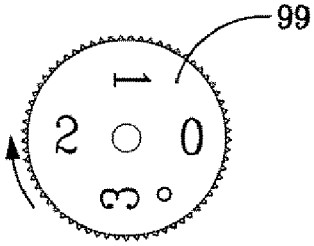
FIG. 18*b* is a top face view of the "outs" dial for the counter of FIG. 12.
Figure 18C:
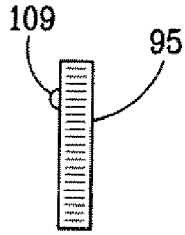
FIG. 18*c* is a side profile view of the four numbered dial of FIG. 18*a* showing the cam button.
Figure 19A:
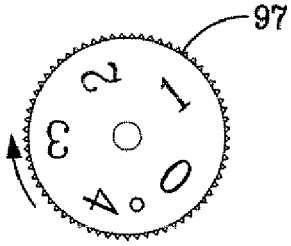
FIG. 19*a* is a top face view of the "balls" dial for the counter of FIG. 12.

This button 109 engages a transversely extending rod 111 attached to each indicator pin/rod 101. In the instance of the tactile indicator pin 101 associated with the "strikes" dial 95, transverse cam-retraction rod 111, FIGS. 16, 20, the camming button 109 engages the transverse rod 111 to retract it inward away from the side wall 113 of the case 93 thereby compressing the biasing spring 115 to withdraw the indicator rod 101 into the case 93. This occurs when the "strikes" dial 95 is turned to "0". As this dial 95 is turned further, the camming button 109 moves beyond the transverse rod 111 as the spring 115 gives a little more and the indicator rod 101 moves a little more inward and the camming button 109 slips off of the transverse rod 111.

Alternately, the structure can be further modified with a plurality of camming buttons 109, and the removal of the "0" camming button 109, so that the pins/rods 101 are withdrawn into the case 93 except when the count of the dial is the number "0".

There is a similar operation when retracting the indicator rods 101 associated with the "balls" dial 97 and the "outs" dial 99. However, because of the direction of rotation of these dials 97, 99 and the position necessitated by the shape and size of the case 93, a hollow connection cable 117 is needed, FIGS. 16, 21. An activation rod 119 slides within each hollow connection cable 117. When either dial 97, 99 is positioned for a zero count, i.e., a "0" is displayed in the viewing window 103, the camming button 109 has pushed against the end of the activation rod which has pushed against the transverse rod 111 associated with that indicator rod 101 which has retracted the rod 111 into the case 93 away from the side wall 113.

Figure 20:
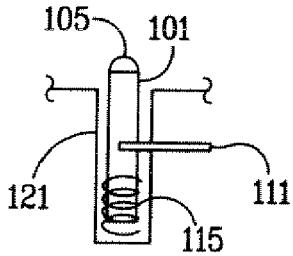
FIG. 20 is a sectional view of a first position indicator rod for the counter of FIG. 12.
Figure 19B:
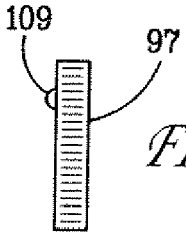
FIG. 19*b* is a side profile view of the five numbered dial of FIG. 19 showing the cam button.
Figure 21:
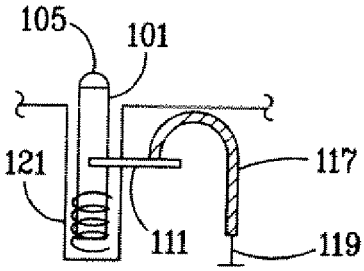
FIG. 21 is a sectional view of a second position indicator rod for the counter of FIG. 12.
Figure 22:
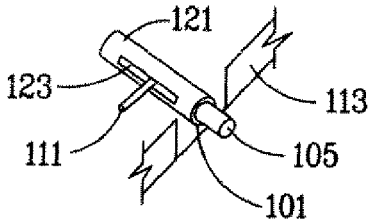
FIG. 22 is a perspective view of the encasement cylinder and position rod at the side wall of the counter of FIG. 12.

Each indicator rod 101 is held within an individual cylinder 121, FIGS. 20, 21, 22, which cylinder has a longitudinal slot 123 through which the transverse rod 111, connected to the respective indicator rod 105, extends. This slot 123 maintains the position of the transverse rod 111 in a proper orientation to camming button 109 for the dial 95. The slot 123 also maintains the position of the respective traverse rods 111 associated with the activation rods 119 for the dials 97 and 99.

Many changes can be made in the above-described invention without departing from the intent and scope thereof.

For example, the notch in the dial could be positioned to indicate the highest digit instead of a zero. Of course, if a notch is used to indicate the null position ("0" position), another tactile indicator, such as a bump-out, or a button, or a triangular-shaped projection, could be used to indicated the highest number, i.e., "strike three", "ball four" or "three outs".

Figure 23:
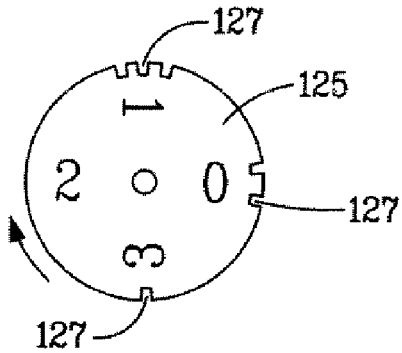
FIG. 23 is a top face view of a four-digit dial with peripheral notches relating to the number shown by the dial.

Alternatively, the periphery, circumferential edge of a dial 125, FIG. 23, can carry a number of notches 127 at each respective location, wherein the number of notches indicates the number shown by the dial. i.e., the instantaneous "count".

It is therefore intended that the above description be read in the illustrative sense and not in the limiting sense. Substitutions and changes can be made while still being within the scope and intent of the invention and of the appended claims.

What is claimed is:

1. A manually operated counter for keeping track of sequential events, comprising:

at lease one dial being tactually rotatably adjustable for sequentially displaying a sequence of each of a plurality of indicia, including an initial indicia, as said dial is sequentially rotated;

wherein each said dial is round, disk-shaped with a serrated edge and is movable in only one direction of rotation whereof continued rotation resets said dial to its initial position, to repeat the sequence; and a tactile indicator operable to indicate when said dial is in said initial position, said tactile indicator having a smooth surface, wherein said tactile indicator is a notch cut into the circumferential serrated edge of each said dial, said notch having smooth walls, and wherein notch is rectangularly shaped with square corners at said circumferential edge of each said dial.

2. The counter of claim 1, wherein each said notch is about 1/16 inch deep and about 1/8 to 3/16 inches wide.

3. The counter of claim 1, wherein each said notch has an arc width of about 15 to 20 circular degrees at its mouth.

4. A manually operated counter for keeping track of sequential events, comprising:

at least one dial being tactually rotatably adjustable for sequentially displaying a sequence of each of a plurality of indicia, including an initial indicia, as said dial is sequentially tactually rotated;

wherein each said dial is round, disk-shaped with a serrated edge and is movable in only one direction of rotation whereof continued rotation resets said dial to its initial position, to repeat the sequence; and a tactile indicator operable to indicate when said dial is in said initial position;

wherein said tactile indicator is a smooth-surfaced bump-out or button extending outwardly on the circumferential edge of each said dial.

5. An manually operated umpire counter, comprising:

a case;

a plurality of disk-shape dials mounted within said case and carrying a plurality of numbers to count respectively, strikes from "0" to "3", balls from "0" to "4", and outs from "0" to "3";

a plurality of viewing windows in the case positioned to display a single number on each of said dials;

wherein each dial has a serrated circumferential edge for the tactile manipulation of said dial to display a different number; and a tactile indicator associated with each said dial to indicate when said respective dial is displaying a "0", said tactile indicator having a surface finish/condition which is different from that of said dial edge;

a respective said tactile indicator extending beyond said case when said respective dial indicates "0" in its respective viewing window.

6. The umpire counter of claim 5, wherein said tactile indicator is a rectangular notch in the circumferential edge of each respective said dial.

7. The umpire counter of claim 6, wherein each said notch is about 1/16 inch deep and about 1/8 to 3/16 inches wide when each said dial has a diameter of about one inch.

8. The umpire counter of claim 5, wherein said tactile indicator is a bump-out/button extending outwardly on the circumferential edge of each said dial.

9. The umpire counter of claim 5, wherein said tactile indicator is a cordial flat surface on the circumferential edge of each said respective dial.

10. The counter of claim 5, wherein said tactile indicator is a respective spring biased pin immediately adjacent a respective dial.

11. The counter of claim 10, wherein each said pin has a smooth rubber tip on its outer end.

12. The counter of claim 10, also including an camming structure attached to each respective dial, and a connection structure connected to a respective spring biased pin for being engaged by said respective dial camming structure, said engagement acting to change the position of said respective spring biased pin.

* * * * *